US010206487B2

(12) United States Patent
Smith et al.

(10) Patent No.: US 10,206,487 B2
(45) Date of Patent: Feb. 19, 2019

(54) HAIR EXTENSION ORGANIZATION DEVICE

(71) Applicants: Madeleine Smith, Santa Barbara, CA (US); Grace Smith, Santa Barbara, CA (US)

(72) Inventors: Madeleine Smith, Santa Barbara, CA (US); Grace Smith, Santa Barbara, CA (US)

( * ) Notice: Subject to any disclaimer, the term of this patent is extended or adjusted under 35 U.S.C. 154(b) by 0 days.

(21) Appl. No.: 15/103,836

(22) PCT Filed: Dec. 10, 2014

(86) PCT No.: PCT/US2014/069609
§ 371 (c)(1),
(2) Date: Jun. 10, 2016

(87) PCT Pub. No.: WO2015/089225
PCT Pub. Date: Jun. 18, 2015

(65) Prior Publication Data

US 2016/0316894 A1 Nov. 3, 2016

Related U.S. Application Data

(60) Provisional application No. 61/914,584, filed on Dec. 11, 2013.

(51) Int. Cl.
*A45D 44/02* (2006.01)
*A45D 44/14* (2006.01)

(52) U.S. Cl.
CPC ..... *A45D 44/14* (2013.01); *A45D 44/02* (2013.01)

(58) Field of Classification Search
CPC . A45D 8/00; A45D 8/34; A45D 8/345; A45D 2008/002; A45D 44/14;
(Continued)

(56) References Cited

U.S. PATENT DOCUMENTS 2,919,702 A * 1/1960 Olivo ..... A45D 24/36 132/200
3,132,778 A * 5/1964 Leclabart ..... A45D 44/14 223/66

(Continued)

OTHER PUBLICATIONS

International Search Report (Form PCT/ISA/210) for International Application No. PCT/US2014/069609 dated Mar. 17, 2015.

*Primary Examiner* — Patrick D Hawn
(74) *Attorney, Agent, or Firm* — Ferguson Case Orr Paterson LLP

(57) ABSTRACT

Disclosed herein are novel devices for the organization and treatment of hair extensions. Devices incorporating features of the present disclosure include objects that can securely hold one or more hair extensions and organize them such that a hairstylist can easily keep track of the various hair extensions and where they are to be placed into a client's existing hair. In some embodiments, the devices comprise a shape similar to that of the human head, providing a convenient visual cue as to the intended placement of a connected hair extension to a client's existing hair. Devices according to the present disclosure can also comprise various connection structures for further securing and organization of connected hair extensions.

12 Claims, 3 Drawing Sheets

(58) Field of Classification Search
CPC ..... A45D 44/02; A45D 44/04; A41G 5/0073; A41G 5/0053; A41G 5/0086; A47F 7/065; A47F 7/06
USPC ..... 132/105; 223/120, 66; 434/94
See application file for complete search history.

(56) References Cited

U.S. PATENT DOCUMENTS 3,188,752 A * 6/1965 Skinner ..... A45D 20/00 219/220
3,320,681 A * 5/1967 Watlington ..... A45D 20/42 211/33
3,515,318 A * 6/1970 Preble ..... A45D 44/14 206/8
3,713,566 A * 1/1973 Perez Perez ..... A45D 44/14 223/66
3,726,022 A * 4/1973 Helwig ..... A45D 44/14 223/66
3,779,433 A * 12/1973 Imai ..... A45D 44/14 223/66
4,317,462 A 3/1982 Steiner
4,370,137 A * 1/1983 Herzig ..... A45D 44/005 434/94
4,403,962 A 9/1983 La Vista
5,252,074 A 10/1993 Passage et al.
5,586,696 A 12/1996 Martinez
7,775,377 B2 8/2010 Abney
8,226,413 B2 7/2012 Yip
8,262,392 B2 * 9/2012 Kubo ..... A45D 44/14 434/94
2003/0175663 A1 * 9/2003 Fuchs ..... G09B 25/00 434/94
2004/0188368 A1 * 9/2004 Hildreth ..... A45D 8/00 211/85.3
2005/0227206 A1 10/2005 Hirata
2007/0221239 A1 9/2007 Lee
2008/0197159 A1 * 8/2008 Ottley ..... A45D 44/14 223/67
2009/0275001 A1 11/2009 Kubo
2013/0104922 A1 5/2013 Hall

* cited by examiner

HAIR EXTENSION ORGANIZATION DEVICE

CROSS REFERENCE TO RELATED APPLICATIONS

This application claims the benefit of U.S. Provisional Patent Application Ser. No. 61/914,584, filed on 11 Dec. 2013, to Maddie Smith, et al., entitled HAIR EXTENSION ORGANIZATION DEVICE, which is hereby incorporated herein in its entirety by reference.

BACKGROUND OF THE INVENTION

Field of the Invention

The present invention relates generally to devices for use in the hairstyling industry and specifically to devices for the organization and treatment of hair extensions.

Description of the Related Art

Hair extensions are widely utilized in modern society to add length to human hair, providing individuals with longer hair capable of various additional styles and appearances unavailable to those with their natural shorter hair. Hair extensions are usually added to a client's existing hair by a hairstylist or other member of the hairstyling industry.

There are many different types of hair extensions known in the art and correlating to different styles, purposes and/or parts of the head. Some example types of hair extensions known in the art include micro-bead hair extensions, fusion hair extensions, clip-in hair extensions, weft hair extensions and tape hair extensions. These various types of hair extensions can utilize different means of attachment and can correlate to different ideal areas of use in relation to the existing hair on a client's head.

During the process of adding hair extensions to a client's existing hair, many hair extension strands are typically utilized. Several of the hair extensions utilized in a treatment are often specifically correlated to certain portions of a client's existing hair and specific locations on a client's head. This can be due to factors such as the color, texture, length and type of hair extension being used. Furthermore, these specific and individualized hair extensions oftentimes need to be further treated, for example, colored, prior to being added to a client's existing hair.

The above individualized requirements, coupled with the fact that several instances of hair extensions are being utilized simultaneously and the natural tendency of hair to tangle, become damaged and snag on various objects, results in a complicated and inefficient process. Time wasted correlating various hair extensions to their corresponding areas on a client's head further adds to the inefficiency of the conventional hair extension process.

An improved device for the organization and treatment of hair extensions is therefore needed.

SUMMARY OF THE INVENTION

Described herein are devices to facilitate the organization and treatment of hair extensions. Devices incorporating features of the present invention can include various indications, such as size, color, indicia and resemblance to the human form (for example the human head), to provide a convenient structure to track the intended corresponding location on a client's head of a hair extension connected to the device.

The present invention can also comprise features to facilitate the securing and stability of hair extensions connected to the devices, for example, features for securing a hair extension in place in an organized manner, preventing tangling and damage to the extension and allowing various hair treatments, such as coloring, to be applied to the extension connected to the device prior to being installed into a client's existing hair.

In some embodiments incorporating features of the present invention, the device comprises a three-dimensional body resembling a human head, similar to a mannequin's head. This provides an immediate visual cue to a hairstylist as to the correct intended placement on a client's head of a hair extension connected to the device.

These and other further features and advantages of the invention would be apparent to those skilled in the art from the following detailed description, taken together with the accompanying drawings, in which:

DETAILED DESCRIPTION OF THE INVENTION

Figure 2:
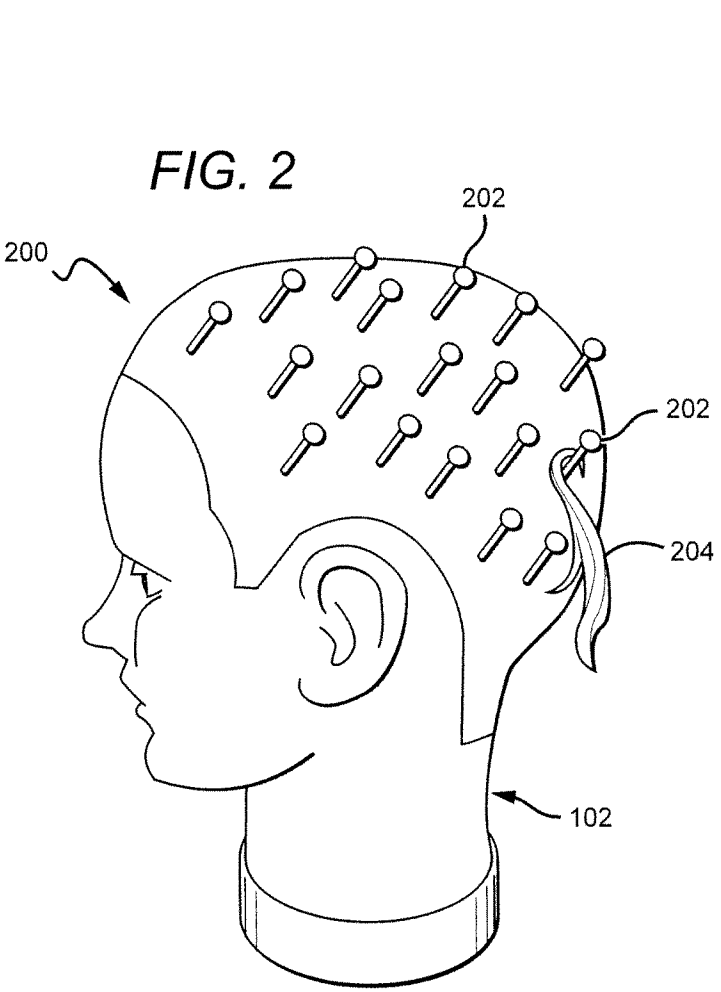
FIG. 2 is a left side perspective view of a hair extension organizer according to another embodiment incorporating features of the present invention.

Devices incorporating features of the present invention provide an efficient means for a hairstylist to organize and/or treat hair extensions while providing the extensions to a client. These devices can resemble a human head in two dimensions (such as a pictorial representation) or three dimensions (such as a statue or mannequin head). In embodiments utilizing a three-dimensional head-shape, hair extensions can be connected to the device in locations corresponding to the hair extension's correct placement in a client's existing hair. This provides a hair stylist with an immediate and instinctive visual cue as to the correct placement location of various hair extensions held by the device, resulting in the ability to easily utilize and organize multiple types of hair extensions without having to substantially examine them multiple times to determine their correct placement location. The hair can be connected to the device in a variety of orientations including, but not limited to vertically, horizontally or diagonally.

To provide an example of use of the above embodiments, a hairstylist can select an extension intended for placement into the existing hair of a client near the right side of a client's occipital bone and connect it to the device near the right side of the head-shape's occipital bone region. This hair extension might have a specific configuration, highlighting/color or length that renders it specific to this location. The hair extension can be treated, for example, colored, straightened, shape-altered, etc., and then left connected to the device while the hairstylist further works on a client's hair or prepares additional hair extensions.

A hairstylist can connect multiple hair extensions to the device, thereby designating their intended locations. For example, with the above mentioned hair extension connected to the occipital bone-representative area of the device, the hairstylist can then prepare another hair extension intended for connection to the portion of a client's existing hair near the center-top portion of a client's head and place it on the corresponding position of the device. Multiple hair extensions can be prepared and attached to the device in this manner, providing an effective organization corresponding to the intended placement of the extensions.

In placing various hair extensions on different areas of the head-shape, the hair extensions are separated by a sufficient distance to prevent them from tangling or otherwise adversely interacting with one another. Devices incorporating features of the present invention can further comprise additional structures such as clips, channels, etc., to further prevent tangling and damage.

While various preferred embodiments of devices incorporating features of the present invention disclosed herein comprise the human head-shape, it is understood that any shape can be used that can provide information as to where an intended hair extension held by the device should be placed in a client's existing hair. For example, a two-dimensional device divided into several spaces capable of connecting and/or placing hair extensions thereon, with each space corresponding to a particular position in a client's existing hair, would be within the scope of the present disclosure.

Hair extensions can be secured to devices incorporating features of the present invention using a variety of different configurations and/or connection structures. For example, hair extensions can be clipped, taped, pinned, placed upon, or otherwise connected to the device. Hair extensions can be connected to the device through separate connection structures and/or via intrinsic structures such as protrusions, indentations and other surface alterations that the device itself comprises.

It is understood that although the terms "hairstylist," "hairstylists," "client," and "clients" are used throughout the present disclosure, these terms encompass any user of devices incorporating features of the present invention and any recipient of hair extension treatment. For example, an individual performing the hair extension treatment is a "hairstylist" within the meaning of this term in the present disclosure. Furthermore, an individual receiving an extension treatment is a "client" within the meaning of this term in the present disclosure. Should one be capable of performing the treatment upon oneself, that individual would be both a "hairstylist" and a "client" within the meaning of these terms in the present disclosure. These terms do not only refer to professional hairstyling industry workers and their clients, and are not meant to limit the present disclosure.

Throughout this description, the preferred embodiment and examples illustrated should be considered as exemplars, rather than as limitations on the present invention. As used herein, the term "invention," "device," "method," "present invention," "present device" or "present method" refers to any one of the embodiments of the invention described herein, and any equivalents. Furthermore, reference to various feature(s) of the "invention," "device," "method," "present invention," "present device" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "outer," "above," "lower," "below," "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

Figure 1:
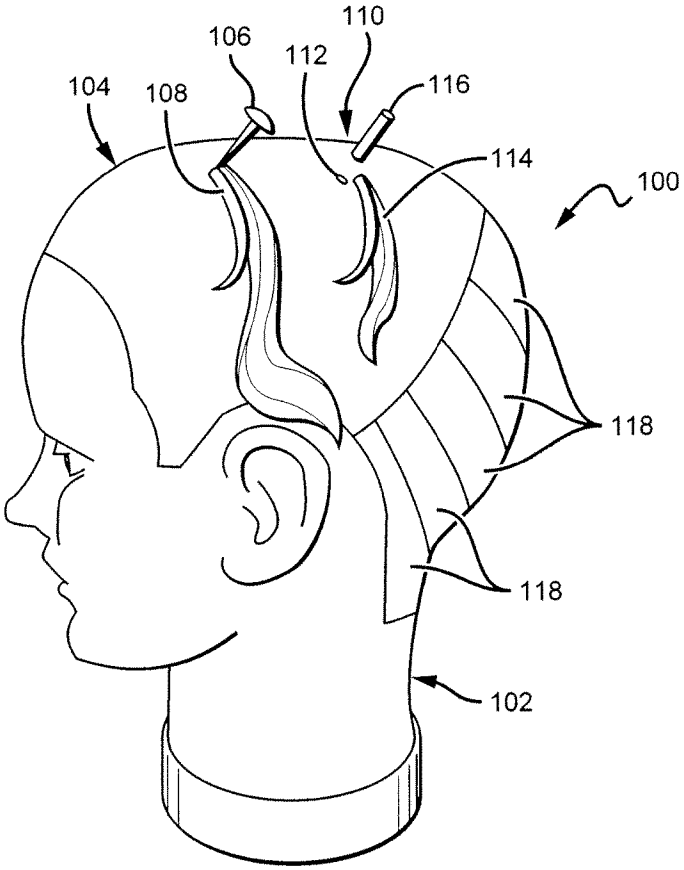
FIG. 1 is a left side perspective view of a hair extension organizer according to an embodiment incorporating features of the present invention.

FIG. 1 shows a hair extension organization device 100 incorporating features of the present invention. The hair extension organization device 100 comprises a body 102 which can be shaped as a human head (as shown) to provide a hairstylist with a convenient visual reference point, such that hair extensions connected to body 102 corresponded to an analogous placement into a client's existing hair on a client's head. In this way, the shape of the body 102 itself provides organizational information as to where a connected hair extension is to be placed without the need for further labeling or for the hairstylist to actively remember which hair extension in a plurality of hair extensions in use is to be applied to which position in a client's existing hair.

The body 102 can be made from any suitable material that could support the connection of hair extensions to the body. Some example materials include, but are not limited to resin, rubber, vinyl, polyurethane, poly vinyl chloride (PVC), polystyrene foam, polymers/copolymer substances, acrylic substances, plastic, leather, metal, wood, cloth or a combination thereof. The body 102 can be formed by any suitable method known in the art, for example, molding, injection molding, stamping and extrusion. While the body 102 is shown in the figures to be shaped similar to a human head, it is understood, as discussed above, that the body can comprise any number of different shapes and sizes including, for example, any regular polygon or a shape imitating an abstract shape or real-world object.

The body 102 can be further divided into sub-regions, for example, a "scalp" region 104. The scalp region 104 can be a designated part of the body 102 itself or can be a separate structure, for example, a replaceable film or membrane. The scalp region 104 and/or any other area of body 102 can be configured to accept hair extensions, by means of, for example, mechanical and chemical treatments, as well as selective composition of the materials, which the body 102 and/or the scalp region 104 comprises. For example, body 102 and/or scalp region 104 can be configured to accept an adhesive strip, such as tape, which can connect a hair extension to a portion of hair extension organization device 100. This configuration can include providing body 102 and/or scalp region 104 with the capability to revive an adhesive strip firmly but allow the adhesive strip to be easily removable.

The body 102 and/or the scalp region 104 can also be configured to accept a hair extension by comprising a material conducive to accepting a pin 106 without causing substantial damage to the body 102 (for example, when body 102 is made of cloth, certain polymers and/or a "self-repairing" material, such as various memory foams) or be otherwise arranged or configured to accept a pin 106 without causing substantial damage (for example, by altering a portion of body 102 via machining or chemical treatment). FIG. 1 shows an example of a pin 106 penetrating a portion of scalp region 104 and affixing a hair extension 108 in place.

FIG. 1 further shows a configuration in which a portion of body 102 and/or scalp region 104 is provided with a hole-and-peg structure 110. A portion of body 102 and/or scalp region 104 can comprise one or more holes 112. A hair extension 114 can be placed on a hole 112 and a peg structure 116, for example a cylindrical rod corresponding in dimensions to the hole, can be inserted into the hole 112, thus sandwiching the hair extension 114 between the hole and peg and affixing the hair extension 114 in place.

The scalp region 104 can be further divided into one or more sub-regions 118 (five shown). These sub-regions 118 can be utilized to further indicate intended positions of connected hair extensions or be used to provide additional information, for example, all extensions in a certain sub-region 118 would receive a particular coloring or texture treatment.

Referring now to FIG. 2, which shows a hair extension organization device 200 similar to the device 100 in FIG. 1 above, wherein like features are denoted with like reference numbers. Like the hair extension organization device 100 in FIG. 1 above, the hair extension organization device 200 of FIG. 2 comprises a body 102. However, the hair extension organization device 200 of FIG. 2 further comprises one or more protrusions 202 (eighteen shown).

These protrusions 202 can be any structure protruding from a portion of body 102. The protrusions 202 can be a protruding structure that is part of body 102 itself, can be formed integrally to body 102, or can be added to body 102 after its formation. Some example protrusions include, but are not limited to: bristles, hooks, raised portions of body 102, Philips bush bristles (e.g. straight protrusions, such as metal protrusions, terminating in a "ball-like" portion as shown), and pin like structures inserted into body 102. These protrusions 202 can also comprise gripping portions such as clips, which will be discussed in more detail further below.

A hairstylist can easily connect a hair extension 204 to a protrusion 202, for example, by allowing the light-weight hair extension 204 to rest on a portion the protrusion 202. If a hair extension 204 is heavier, perhaps due to an excessive length or components such as beads therein, the hairstylist can simply loop a greater length of the hair extension 204 around the protrusion 202.

Figure 3:
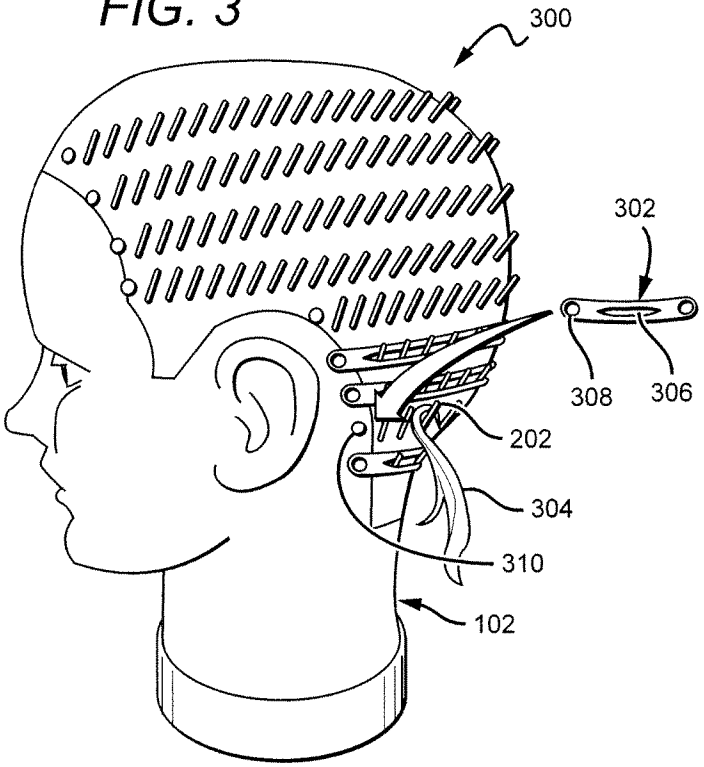
FIG. 3 is a left side perspective view of a hair extension organizer according to still another embodiment incorporating features of the present invention.

FIG. 3 shows a hair extension organization device 300, similar to the hair extension organization device 200 in FIG. 2 above, wherein like features are denoted with like reference numbers. Like the hair extension organization device 200 in FIG. 2 above, the device 300 of FIG. 3 comprises a body 102 and protrusions 202, which are organized in rows positioned on different areas of the body 102. However, FIG. 3 shows an exemplary additional restraining structure 302 that can be utilized to further secure and organize hair extensions. Like in FIG. 2 above, a hairstylist can connect a hair extension 304 to a protrusion 202. The hairstylist can then sandwich the hair extension 304 between the body 102 of the hair extension organization device 300 and the restraining structure 302, adding additional organization and further preventing tangling and damage to the hair extension 304.

The restraining structure 302 can be any structure that can be securely placed on body 102 to further hold a hair extension 304 in place. In the embodiment shown, the restraining structure 302 comprises one or more windows 306 (one shown) and a first connection element 308 designed to interact or mate with a corresponding second connection element 310 on body 102, thus securing restraining structure 302 in place on the body 102 and over the hair extension 304.

As an additional organization feature, a hairstylist can feed a portion of a hair extension 304 through the window 306 of a restraining structure 302. This allows for additional control and organization of how a hair extension 304 hangs in relation to body 102 and further prevents unwanted motion, damage and tangling.

Multiple restraining structures 302 can be connected together to further customize hair securing configurations. This can be done by any suitable connecting structure, for example, a knob or other structure that can interact or mate with a corresponding structure on another restraining structure. In some embodiments, the first connection element 308 can interact or mate with a corresponding connection element on an adjacent restraining structure 302. This allows for further customization of restraining structure configurations, for example, wherein each restraining structure in a connected plurality of restraining structures secures a given number of hair extensions.

Figure 4:
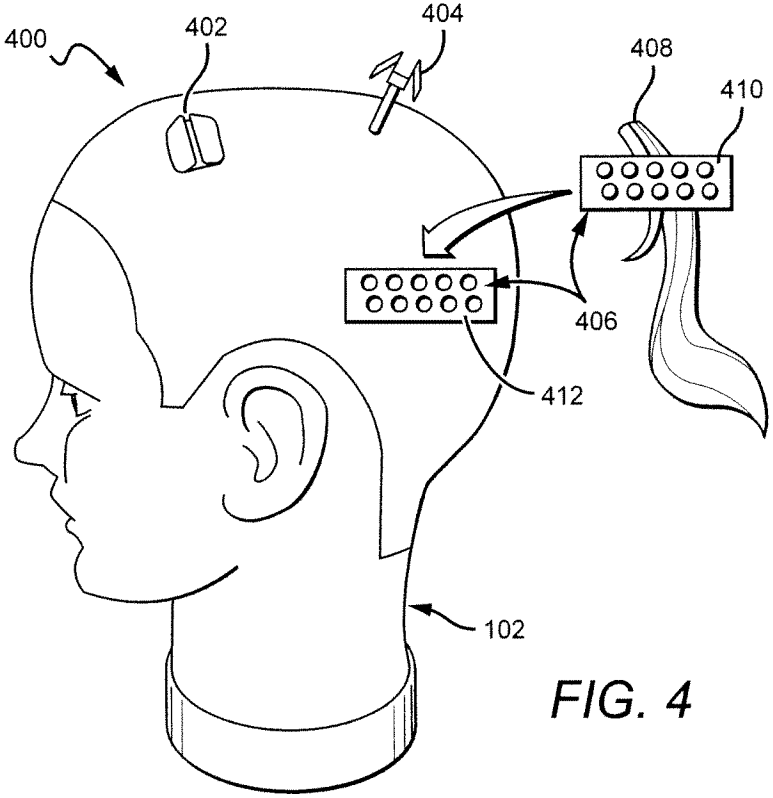
FIG. 4 is a left side perspective view of a hair extension organizer according to yet another embodiment incorporating features of the present invention.

FIG. 4 shows a hair extension organization device 400, similar to the hair extension organization device 100 in FIG. 1 above, wherein like features are denoted with like reference numbers. Like the hair extension organization device 100 in FIG. 1 above, the device 400 of FIG. 4 comprises a body 102. However, the hair extension organization device 400 of FIG. 4 demonstrates further features for securing hair extensions to the body 102 that can be utilized with embodiments incorporating features of the present invention.

As discussed above, hair extension organization devices can comprise protrusions to further secure hair extensions to the device. However, as shown in FIG. 4, hair extension organization devices can further or alternatively comprise one or more indentations 402 (one shown). A hairstylist can insert a portion of a hair extension into such an indentation 402, thus holding the hair extension in place. The indentation 402 can comprise additional gripping mechanisms or other features, such as narrowed sidewalls to further facilitate holding the hair extension in place.

As shown in FIG. 4, hair extension organization devices can also comprise gripping or clip structures 404, which can physically grip a hair extension, holding it in place. The hair extension organization device 400 of FIG. 4 can also comprise an intermediate connection structure arrangement 406. In this intermediate connection structure arrangement 406, a hair extension 408 is connected to a first complimentary structure 410, for example, by any of the connection configurations disclosed herein or any suitable connection configuration, which in turn is connected to a second complimentary structure 412, which is on or part of body 102. Alternatively or in addition to connecting the hair extension 408 to the first complimentary structure 410, the hair extension 408 can simply be sandwiched between the first complimentary structure 410 and the second complimentary structure 412, thus affixing the hair extension 408 in place to body 102 in a manner similar to that discussed in regard to FIG. 3 above. Examples of such complimentary structures include hook and loop structures (such as Velcro), button structures, snap-fit structures and any structure designed with two or more complimentary portions configured to interact or mate together. In some embodiments, multiple first complementary structures 410 can be connected together to form rows of hair extensions and the rows can be subsequently connected to the second complementary structure 412.

Figure 5:
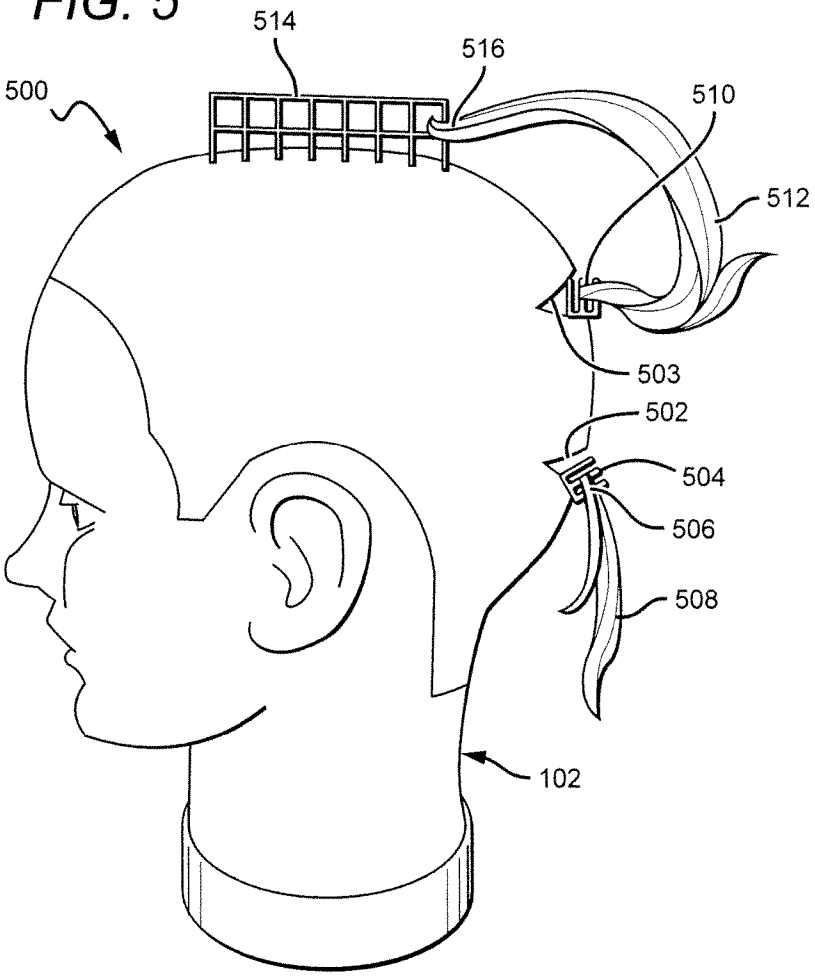
FIG. 5 is a left side perspective view of a hair extension organizer according to still another further embodiment incorporating features of the present invention.

FIG. 5 shows a hair extension organization device 500, similar to the hair extension organization device 100 in FIG. 1 above, wherein like features are denoted with like reference numbers. Like the hair extension organization device 100 in FIG. 1 above, the device 400 of FIG. 5 comprises a body 102. However, the hair extension organization device 500 of FIG. 5 demonstrates still further features for securing hair extensions to the body 102 that can be utilized with embodiments incorporating features of the present invention.

The hair extension organization device 500 can comprise one or more securing grooves 502, 503 (two shown), which can comprise a moveable securing structure 504, which can be connected to the body 102 by a variety of connection configurations that allow movement of the moveable securing structure 504 in relation to the body 102. For example, the movable securing structure 504 can be connected to the body sliding structures, complementary structures for free removability and attachment, pivot joints, ball and socket joints, condyloid (ellipsoid) joints, saddle joints and hinge joints, including living hinges. The movability of the moveable securing structure 504 allows for it to be moved into various positions as desired by a user for different functions, for example, allowing for convenient access to the moveable securing structure 504 to allow for easy installation of a hair extension in one position and a more secure connection of a hair extension to the body 102 in another position.

In the embodiment shown in FIG. 5, the moveable securing structure 504 comprises a comb-like structure that allows for connection of a first end 506 of a hair extension 508 to the moveable securing structure, although it is understood that any other suitable structure that can facilitate connection of a hair extension can be utilized, for example, other structures described in the various embodiments discussed herein. The first securing groove 502 is shown in an "open" position, wherein the moveable securing structure 504 is positioned at least partially away from the body 102 in order to allow more freedom of access to the moveable securing structure 504 and to facilitate connection of a hair extension to the moveable securing structure. The second securing groove 503 is shown in the "closed" position wherein a first end 510 of a hair extension 512 can be better secured to the body 102, for example, by pinning a portion of the first end 510 of the hair extension 512 to the body 102. It is understood that while the term "end" is used for convenience in the present disclosure, other portions of a hair extension can also be utilized and connected to the body 102.

Another additional feature according to the preset disclosure is that the body 102 can comprise one or more stabilization structures 514, which can be incorporated into any of devices and disclosed embodiments set forth herein. The purpose of the stabilization structure 514 is to connect a second (e.g. opposite) end 516 of a hair extension 512 to the body 102. By connecting both ends of a hair extension to body 102, a user can prevent a hair extension higher on body 102 from dangling downward and interfering with the user's work on or treatment of a different hair extension connected to the body 102 at a lower position on the body 102.

The stabilization structure is shown in FIG. 5 as a grid-like structure, with openings and support beams (as shown), which is convenient as the spread out space of the grid-like structure it allows for multiple hair extensions connected to the body 102 in different locations to have their opposite ends connected to different locations on the same single grid-like structure, thus conserving space on the body 102. In other embodiments, multiple stabilization structures 514 can be utilized. The stabilization structure 514 can comprise any shape or configuration that facilitates connection of a portion of a hair extension, such as an end, to the body 102, for example, any of the connection and securing structures disclosed herein.

In addition to enhanced organization and convenient placement of hair extensions, devices according to the present disclosure also allow for the hair extensions to be held in place and individually treated, for example, colored, straightened, etc., while allowing both of a hairstylist's hands to be free to perform the treatment.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention.

We claim:

1. A hair extension organization device, comprising:

a body;

a plurality of protrusions connected together into a comb-structure connected to said body, said protrusions comprising a first protrusion-end near said body and extending in a direction from said body to a second protrusion-end opposite and distal from said first protrusion-end, wherein a width of at least one of said protrusions in said plurality of protrusions from said first protrusion-end to said second protrusion-end is substantially constant across said at least one protrusion from said first protrusion-end to said second protrusion-end, wherein said plurality of protrusions are configured to directly connect to at least one hair extension by providing a length to enable said hair extension to loop around said protrusion;

wherein said body is configured to resemble a human head, including a portion representative of regions on a human head where hair would grow, to indicate to a user that a hair extension connected to said body corresponds to a specific intended location; wherein said body comprises a stabilization structure configured to connect the opposite end of a hair extension that has its other end connected to said at least a portion of said body.

2. The hair extension organization device of claim 1, wherein at least a portion of said body comprises one or more indentations configured to connect one or more hair extensions to said body.

3. The hair extension organization device of claim 1, wherein at least a portion of said body comprises one or more gripping structures configured to connect one or more hair extensions to said body.

4. The hair extension organization device of claim 1, wherein at least a portion of said body comprises one or more moveable securing structures configured to connect one or more hair extensions to said body.

5. The hair extension organization device of claim 1, wherein said body further comprises a connection element, said connection element configured to accept a restraining structure for further securing one or more hair extensions to said body.

6. The hair extension organization device of claim 1, wherein said comb-structure is moveably connected to said body.

7. A hair extension organization device, comprising:

a body;

a first plurality of protrusions connected to said body in a first region of said body, and a second plurality of protrusions connected to said body in a second region of said body, at least one of said first plurality of protrusions and said second plurality of protrusions connected together into a comb-structure connected to said body, said first plurality of protrusions and said second plurality of protrusions comprising a first protrusion-end near said body and extending in a direction from said body to a second protrusion-end opposite and distal from said first protrusion-end, wherein a width of at least one of said protrusions in said plurality of protrusions from said first protrusion-end to said second protrusion-end is substantially constant across said at least one protrusion from said first protrusion-end to said second protrusion-end, wherein said first region of said body is separate from said second region of said body, a protrusion within said first plurality of protrusions or said second plurality of protrusions configured to directly connect to at least one hair extension by providing a length to enable said hair extension to loop around said protrusion in said first plurality of protrusions or said second plurality of protrusions;

wherein said body is configured to resemble a human head, including a portion representative of regions on a human head where hair would grow, to indicate to a user that a hair extension connected to said body corresponds to a specific intended location; wherein said body comprises a stabilization structure configured to connect the opposite end of a hair extension that has its other end connected to said one or more protrusions.

8. The hair extension organization device of claim 7, wherein said body further comprises a connection element, said connection element configured to accept a restraining structure for further securing one or more hair extensions to said body.

9. The hair extension organization device of claim 8, wherein said connection element further comprises a window for further holding said hair extension in place.

10. The hair extension organization device of claim 7, wherein said comb-structure is moveably connected to said body.

11. A hair extension organization device, comprising:

a body;

a plurality of protrusions connected together into a comb-structure connected to said body, said protrusions comprising a first protrusion-end near said body and extending in a direction from said body to a second protrusion-end opposite and distal from said first protrusion-end, wherein a width of at least one of said protrusions in said plurality of protrusions from said first protrusion-end to said second protrusion-end is substantially constant across said at least one protrusion from said first protrusion-end to said second protrusion-end end, wherein said plurality of protrusions are configured to directly connect to at least one hair extension by providing a length to enable a first end of a hair extension to loop around a corresponding one of said protrusions; and one or more stabilization structures positioned higher on said body than said one or more protrusions, said one or more stabilization structures configured to connect a second end of said hair extension to said body; and wherein at least one of said one or more stabilization structures comprises a grid structure.

12. The hair extension organization device of claim wherein said comb-structure is moveably connected to said body.

* * * * *